US007393308B1

(12) United States Patent
Huang

(10) Patent No.: US 7,393,308 B1
(45) Date of Patent: Jul. 1, 2008

(54) FITNESS EQUIPMENT WITH MULTIPLE FUNCTIONS

(76) Inventor: Ling-Yun Huang, No. 10, Alley 314, Lane 68, Shanyuan Rd., Fongyuan City, Taichung County (TW)

( * ) Notice: Subject to any disclaimer, the term of this patent is extended or adjusted under 35 U.S.C. 154(b) by 0 days.

(21) Appl. No.: 11/535,041

(22) Filed: Sep. 25, 2006

(51) Int. Cl.
*A63B 22/00* (2006.01)

(52) U.S. Cl. ..... 482/51; 482/57

(58) Field of Classification Search ..... 482/57, 482/62–65, 70, 95–96, 51
See application file for complete search history.

(56) References Cited

U.S. PATENT DOCUMENTS 2,107,447 A * 2/1938 Marlowe ..... 482/63
4,729,559 A * 3/1988 McNeil ..... 482/62
5,458,553 A * 10/1995 Wu ..... 482/95
5,533,953 A * 7/1996 Lui et al. ..... 482/96
5,582,562 A * 12/1996 Wang et al. ..... 482/95
5,672,142 A * 9/1997 Wu ..... 482/96
7,097,598 B2 * 8/2006 Lee ..... 482/57
2007/0173381 A1 * 7/2007 Chen et al. ..... 482/57

* cited by examiner

*Primary Examiner*—LoAn H. Thanh
*Assistant Examiner*—Ryan Durcik
(74) *Attorney, Agent, or Firm*—Egbert Law Offices

(57) ABSTRACT

The present invention is fitness equipment with multiple functions. The fitness equipment includes a main frame, rotatable head rack, handrail rack, seat set, linkage bar, damping device and a rotatable treadle device. With the coupled configuration of rotatable head rack, seat set, linkage bar and damping device, trampling, hand-pulling and buttock lifting exercises can be achieved. The fitness equipment meets diversified requirements for both horse-riding and trampling, and also saves the space and cost.

12 Claims, 12 Drawing Sheets

FITNESS EQUIPMENT WITH MULTIPLE FUNCTIONS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to fitness equipment, and more particularly to improved fitness equipment with horse-riding and foot-operated mechanisms.

2. Description of Related Art Including Information Disclosed Under 37 CFR 1.97 and 37 CFR 1.98

There is a variety of fitness equipment currently available with single or multiple functions for the user.

The present invention relates generally to an improved fitness equipment with horse-riding or pedal fitness mechanisms. A single function horseback riding fitness equipment often requires a series of movements, including trampling, hand-pulling and buttock lifting. The equipment is placed at a site where space is at a premium. Also, the user has to make more physical efforts to lift their buttocks for body-building, thus making them lose interest quickly. The single function pedal fitness equipment is also commonly used as similar to a treadmill. Despite a longer history, this fitness equipment has only simple functions such as movement of legs and feet in a limited environment, making it difficult to meet various demanding exercise requirements of a user.

Thus, to overcome the aforementioned problems of the prior art, it would be an advancement in the art to provide an improved structure that can significantly improve efficacy.

To this end, the inventor has provided the present invention of practicability after deliberate design and evaluation based on years of experience in the production, development and design of related products.

BRIEF SUMMARY OF THE INVENTION

The present invention has offered an innovative structure, including a main frame 10, rotatable head rack 20, handrail rack 30, seat set 40, linkage bar 50, damping device 60 and rotatable treadle device 70. This fitness equipment is able to meet the diversified requirements for both horse-riding and trampling, while also saving space and cost. The rotatable treadle device is operated when the damping device 74 is driven by the crank 72 and treadle 73, rather than a traditional belt drive mode, thus delivering a simpler and space-saving structure.

The underframe 11 of main frame 10 comprises a cross-bar 111 and a rotatable wheel rack 112. The underframe 11 is grounded reliably by cross-bar 111 when the bottom of rotatable wheel rack 112 rotates upwards. In such a case, the fitness equipment is optimally suited for a user. When the bottom of rotatable wheel rack 112 rotates downwards, the location of wheel body 114 is lowered down to the bottom of cross-bar 111, placing the wheel body 114 into a sliding state and enabling the user to easily shift the fitness equipment.

The damping device 60 is a pneumatic shaft used to support rotatable rack 42 of seat set 40. A user can perform the horse-riding exercise easily by pressing down with body weight. When the user lifts their buttocks, an auxiliary supporting force will be applied to perform the exercise more easily and ergonomically, since the rotatable rack 42 of seat set 40 can make use of the upward resetting from the damping device 60.

A sliding chute 420 is placed at rear end of rotatable rack 42 of the seat set 40, such that upright rod 43 of the cushion 41 is fitted with a linkage tube 431. The linkage tube 431 is retractable in the sliding chute 420, and the cushion 41 can be adjusted flexibly to meet the requirements of different players.

The foot rest 23 at a bottom of rotatable head rack 20 comprises a horizontal support 231, a linkage seat 232, a rotary extension rod 233 and a foot plate 234. While performing the horse-riding exercise, the user may select to place their feet on horizontal support 231 or foot plate 234 to meet different demands, or obtain different effects and experience in the activity.

A support frame 13 is mounted between the rotatable rack 42 of seat set 40 and upper-frame 12 of main frame 10. The support frame 13 can be used to control or switch the rotating or positioning state of rotatable rack 42, thus serving the purpose of horse-riding and trampling.

A C-shaped jacket 90 is placed at top of upright rod 43 of the rotatable rack 42, and a convex lug 92 is set at the lateral gap 91 to adjust the tightness of C-shaped jacket 90 through bolt 93 and screw cap 94. It is possible to switch the lifting or positioning state of cushion 41 (inclusive of avoiding rotation and lifting of cushion 41) by adjusting the tightness of C-shaped jacket 90. To loosely adjust the C-shaped jacket 90, the nose bar 46 can be loosened, such that the cushion 41 could elevate flexibly according to the height of the user.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
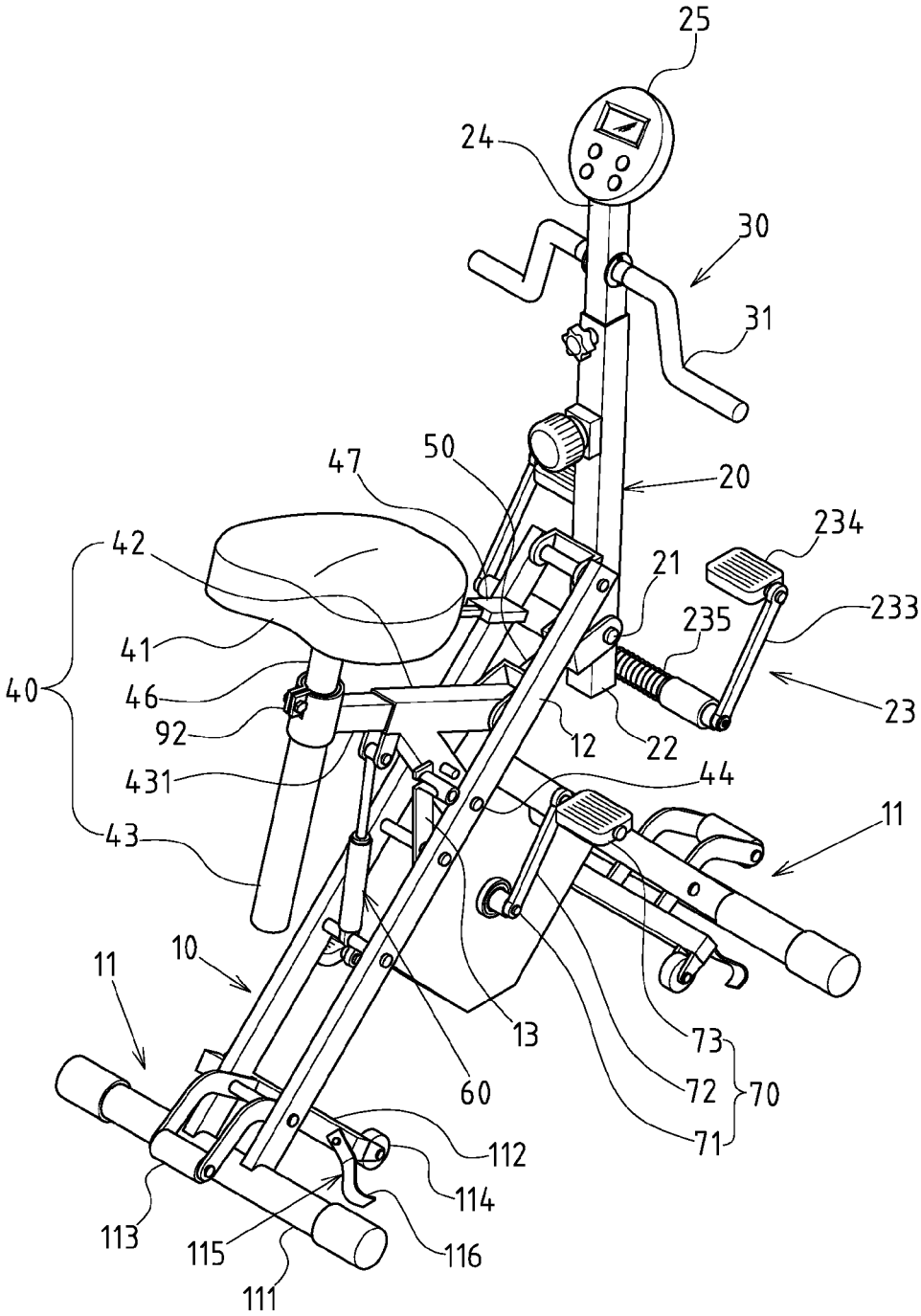
FIG. 1 shows an assembled perspective view of the entire structure of the fitness equipment of the present invention.
Figure 2:
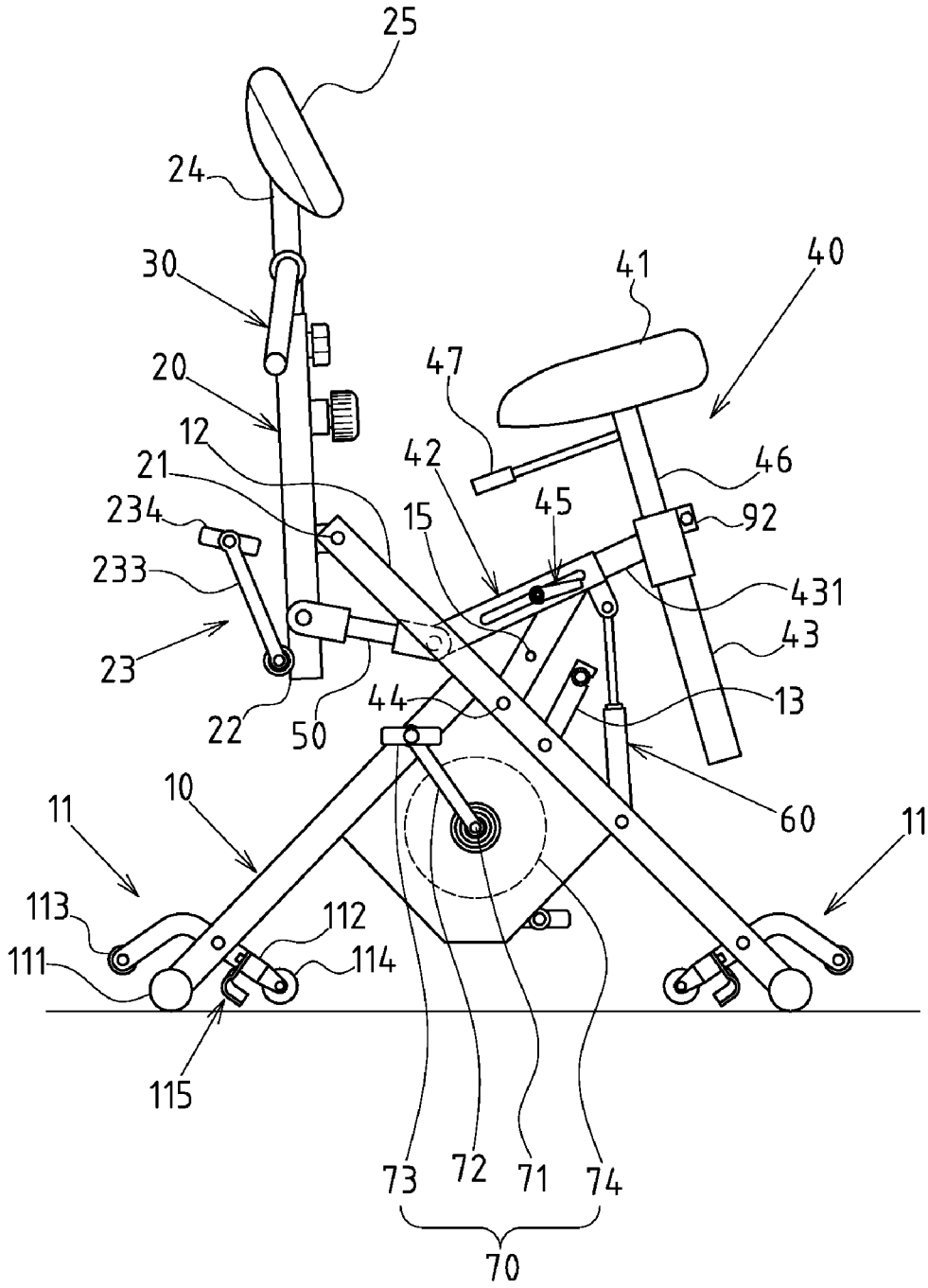
FIG. 2 shows an assembled side elevation view of the entire structure of the fitness equipment of the present invention.

FIGS. 1 and 2 depict preferred embodiments of the fitness equipment with multiple functions of the present invention. These embodiments are for descriptive purposes only. The present invention is not limited to these exact embodiments.

The fitness equipment with multiple functions includes a main frame 10, which comprises a frontal and rear underframe 11 and an upper-frame 12. The main frame 10 is has a 人structure.

A rotatable head rack 20 has its lower section screwed into top of upper-frame 12 of main frame 10 via a shaft 21. The bottom 22 of rotatable head rack 20 extends downwards, and foot rest 23 is placed at both sides of the bottom 22. A control panel 25 is mounted onto top 24 of the rotatable head rack 20.

A handrail rack 30 is mounted onto preset top location of rotatable head rack 20.

A seat set 40 comprises a cushion 41 and a rotatable rack 42, of which an upright rod 43 is placed at rear of rotatable rack 42 for assembly of cushion 41. The bottom of rotatable rack 42 is screwed into preset bottom of upper-frame 12 of main frame 10 via a shaft 44.

A linkage bar 50 is used to link the bottom 22 of rotatable head rack 20 to the front end of rotatable rack 42 of seat set 40.

A damping device 60 is mounted between rotatable rack 42 of seat set 40 and main frame 10, such that a resisting force is applied to downward rotation of rotatable rack 42. The damping device of the preferred embodiment is a retractable pneumatic shaft used to support rotatable rack 42 of seat set 40.

A rotatable treadle device 70 is mounted into a preset location of main frame 10, comprising a mandrel 71, a side crank 72 and a treadle 73 and a damping device 74. The side crank 72 is placed at both sides of mandrel 71 at a 180 degrees. The damping device 74 may be formed by a magnetic flywheel.

Figure 3:
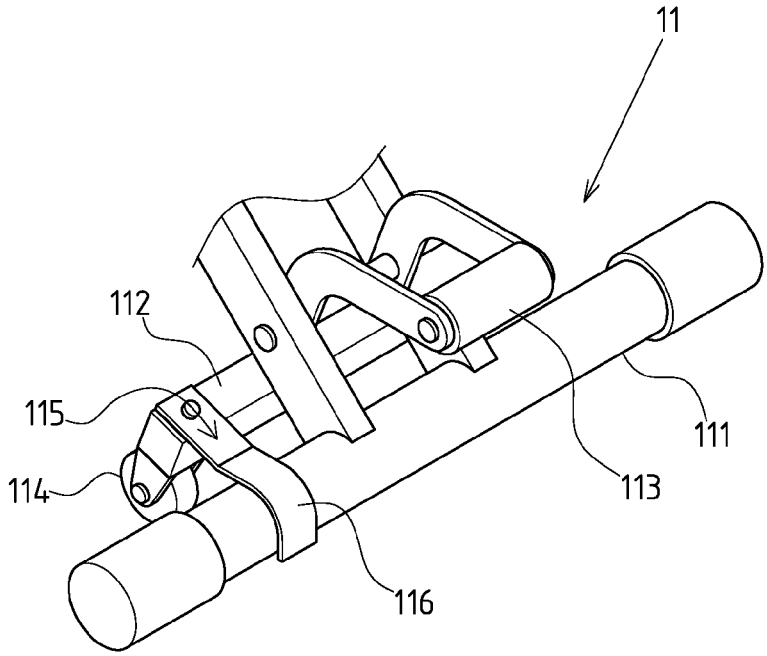
FIG. 3 shows a perspective view of underframe of the present invention with the wheel body in a grounding state.
Figure 4:
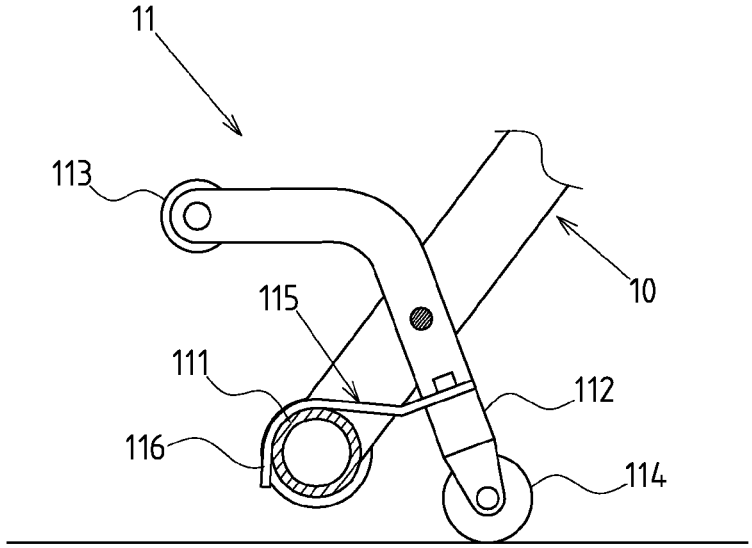
FIG. 4 shows a side elevation view of underframe of the present invention with the wheel body in a grounding state.
Figure 5:
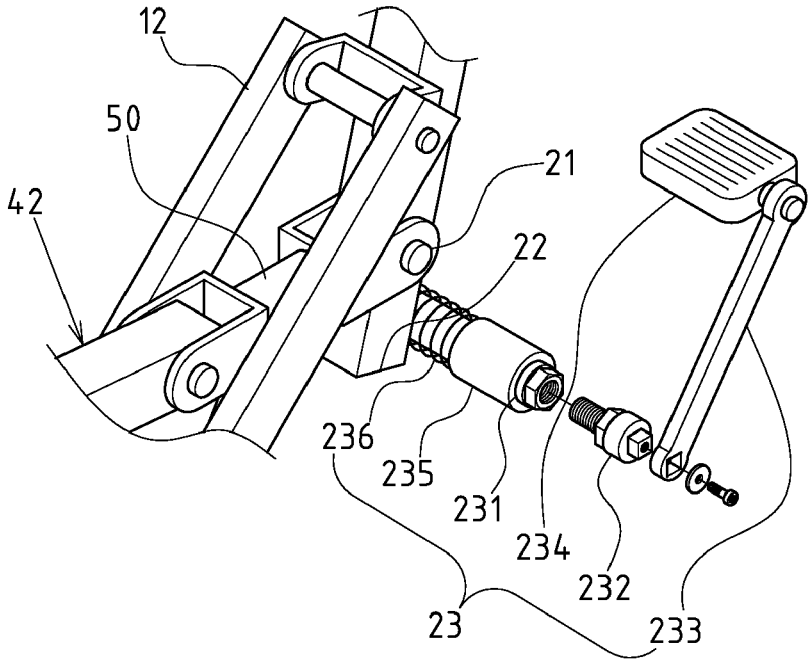
FIG. 5 shows an exploded perspective view of the foot rest of the present invention.
Figure 6:
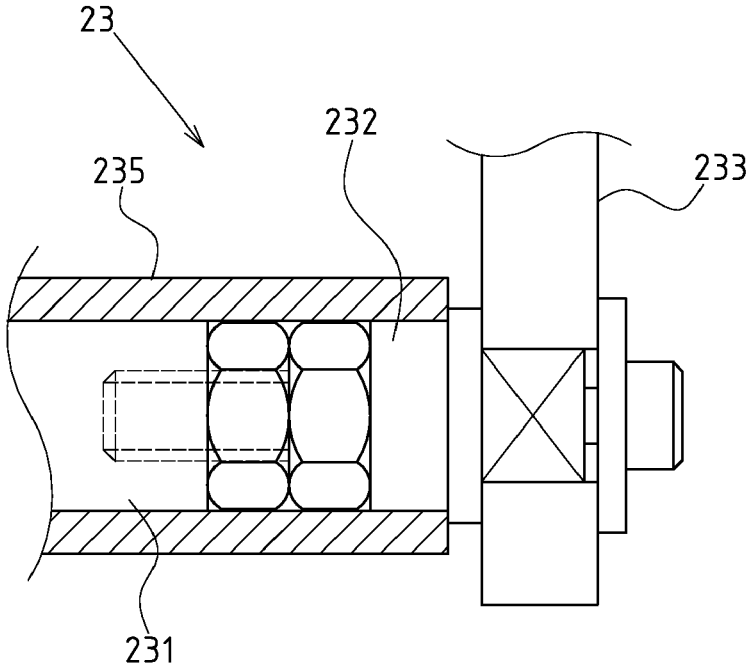
FIG. 6 shows an assembled sectional view of components of feet rest of the present invention.

The underframe 11 of the main frame 10 comprises a cross-bar 111 and a rotatable wheel rack 112. The rotatable wheel rack 112 and cross-bar 111 are arranged alternatively on the main frame 10. A spanner 113 is fixed at top of rotatable wheel rack 112, and a wheel body 114 at the bottom. When the bottom of rotatable wheel rack 112 rotates upwards (as shown in FIG. 2), the underframe 11 of main frame 10 is grounded tightly by the cross-bar 111. When the bottom of rotatable wheel rack 112 rotates downwards (as shown in FIGS. 3, 4), the location of wheel body 114 is lowered down to the bottom of cross-bar 111, placing the wheel body 114 in a sliding state. The bottom of rotatable wheel rack 112 shall be fastened by a locator. The locator of the preferred embodiment is a hook-type plate 115 screwed into a preset location of rotatable wheel rack 112. When the bottom of rotatable wheel rack 112 rotates downwards, the hook-type plate 115 enables the hook 116 to be snapped onto the top of cross-bar 111 for positioning.

Figure 17:
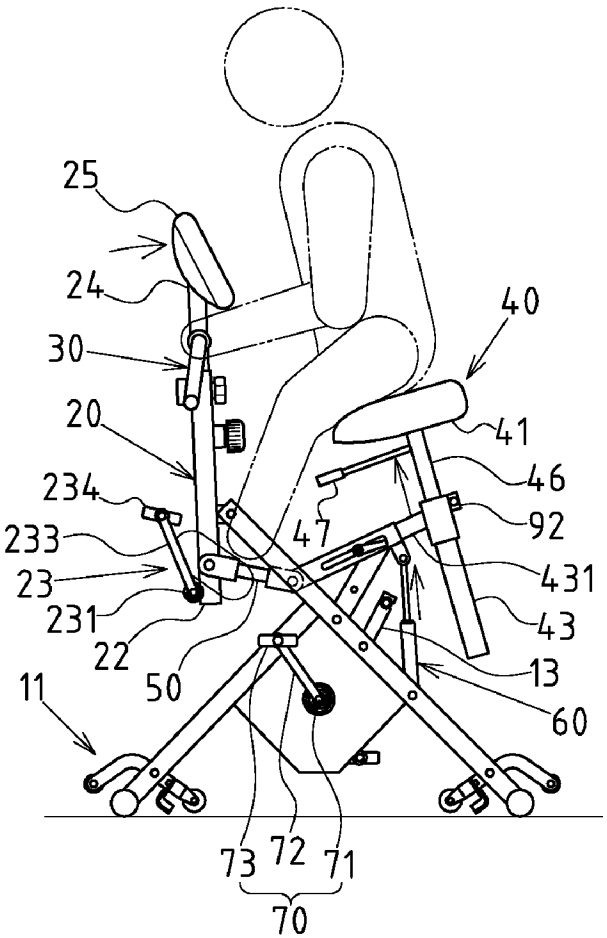
FIG. 17 shows an elevation view of the present invention in a state of operation.
Figure 20:
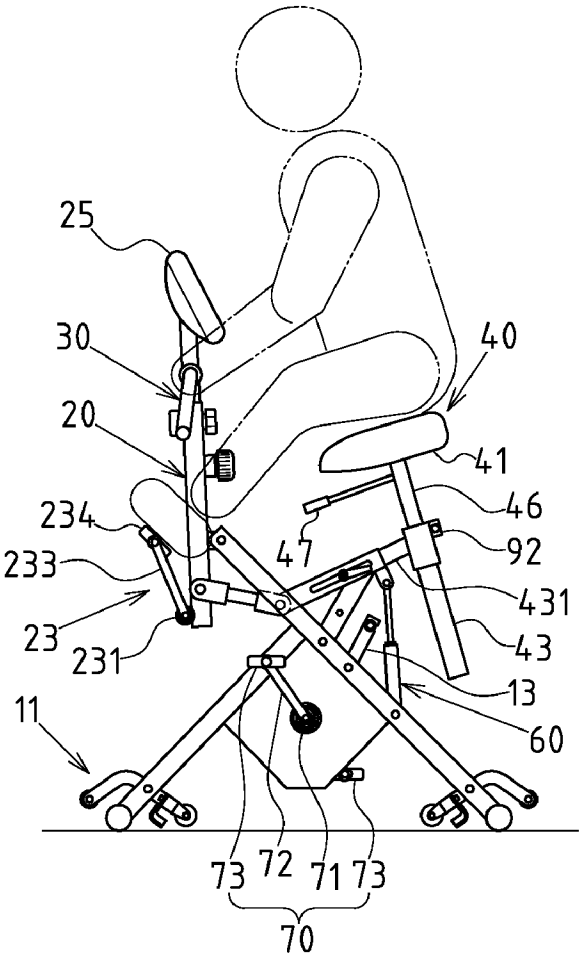
FIG. 20 shows an elevation view of the present invention in still another state of operation.

A foot rest 23, mounted at both sides of bottom of rotatable head rack 20, comprises horizontal support 231, linkage seat 232, rotary extension rod 233 and a foot plate 234. The horizontal support 231 and linkage seat 232 are fastened tightly by screw and bolt. The coupling end of rotary extension rod 233 is placed externally at linkage seat 232, while the foot plate 234 is placed at extension end of rotary extension rod 233. A sleeve 235 and a spring 236 are retained at external of horizontal support 231 and linkage seat 232, and the spring 236 drives the sleeve 235 towards horizontal support 231 and linkage seat 232 to cover the linkage part. The foot rest 23 allows a user to place their feet on the horizontal support 231 (as shown in FIG. 17) or on foot plate 234 (as shown in FIG. 20) to obtain different effects and experience in the activity.

Figure 7:
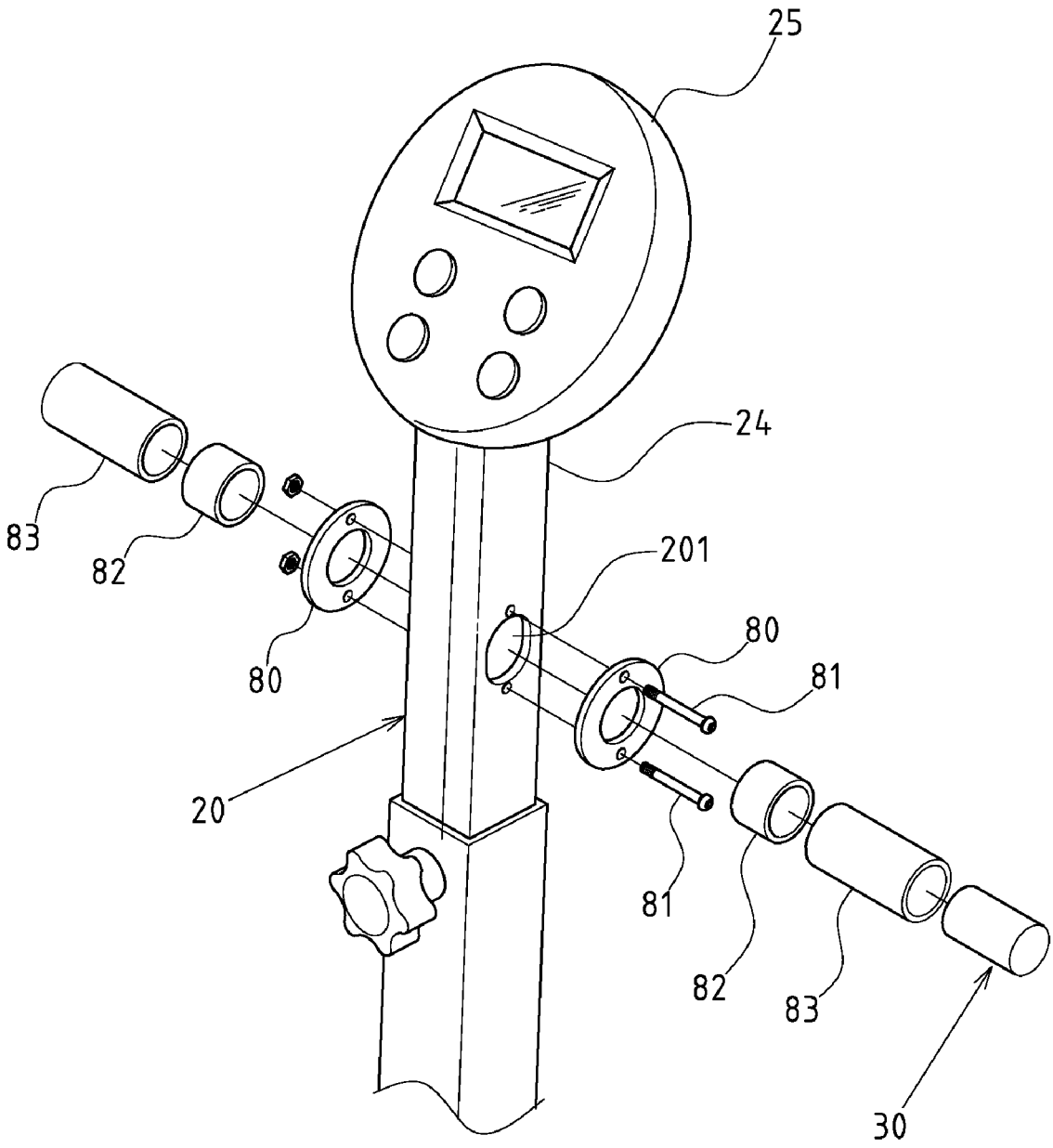
FIG. 7 shows an exploded perspective view of the handrail rack of the present invention.
Figure 8:
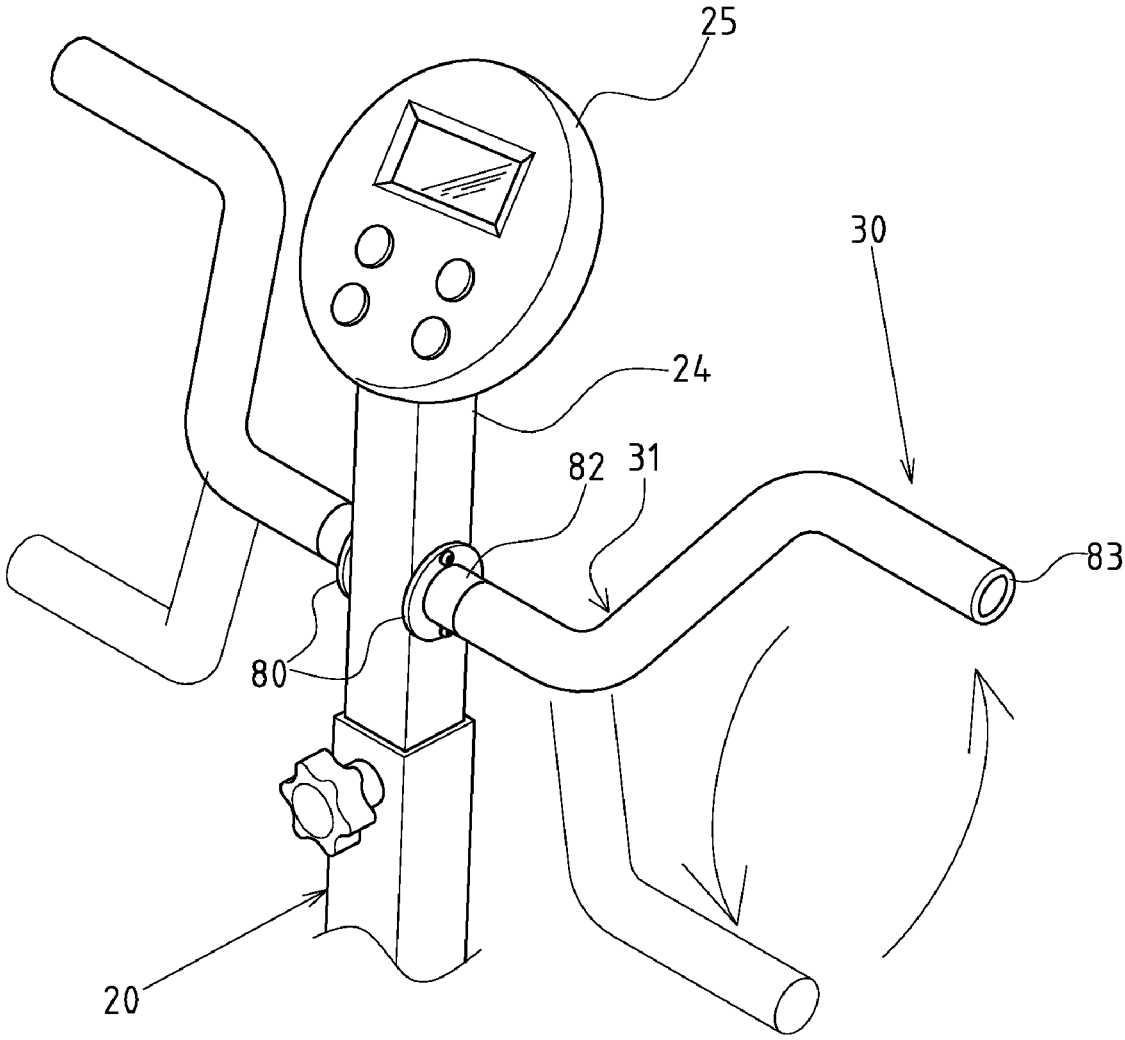
FIG. 8 shows an assembled perspective view of the handrail rack of the present invention, showing various positions while operating.
Figure 9:
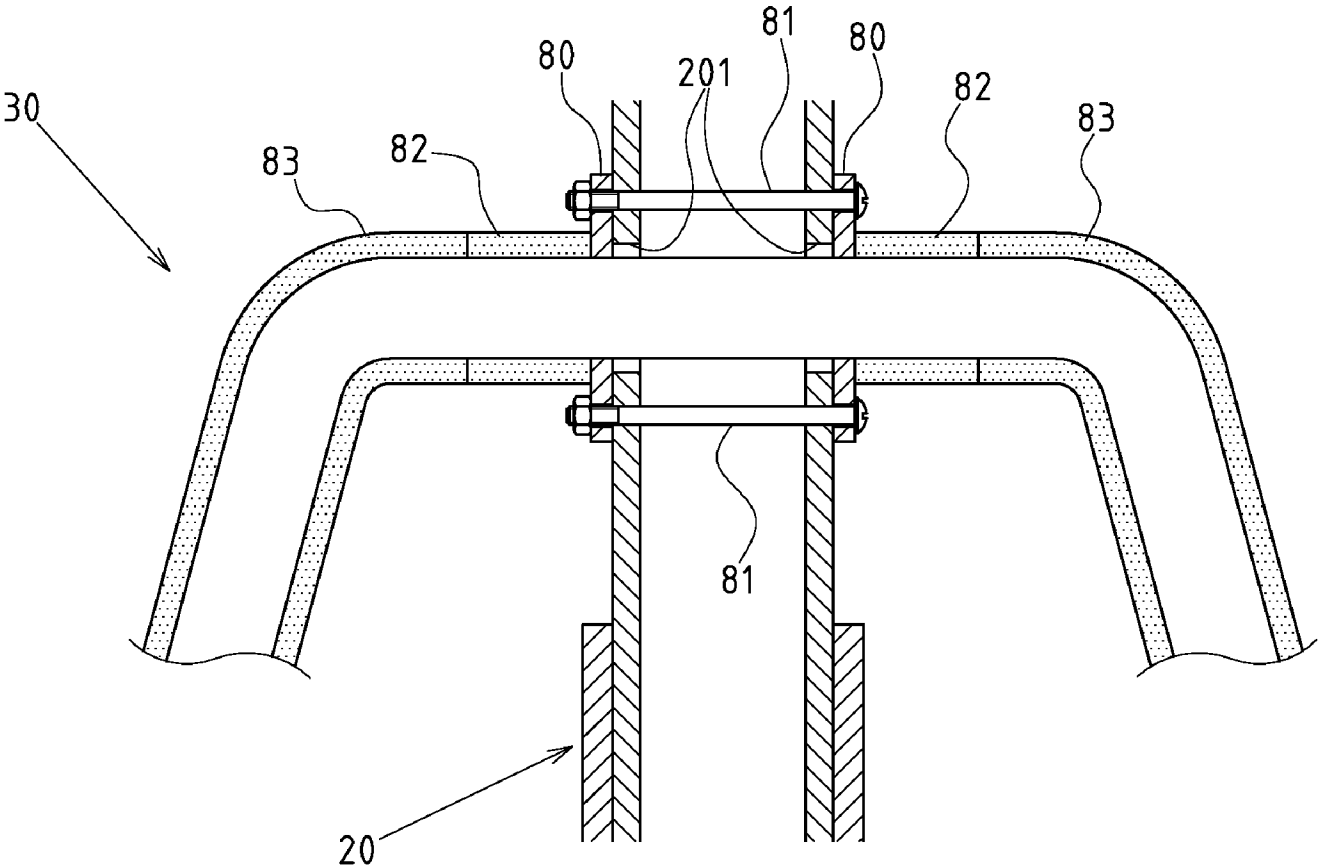
FIG. 9 shows an assembled sectional view of the handrail rack of the present invention.

Referring to FIG. 7, both sides of handrail rack 30 have a curved section 31 such that a transverse hole 201 could be set at top of rotatable head rack 20 for assembly of handrail rack 30. In addition, two locators 80 are adhered to both sides of transverse hole 201, and fastened by two bolt locators 81. The curved section 31 at both ends of handrail rack 30 can be covered by a flexible superficial coat, which comprises two short flexible coats 82 and two long flexible coats 83. Two short flexible coats 82 are firstly inserted into handrail rack 30 such that the handrail rack 30 can be aligned centrally, and then two long flexible coats 83 are assembled.

Figure 10:
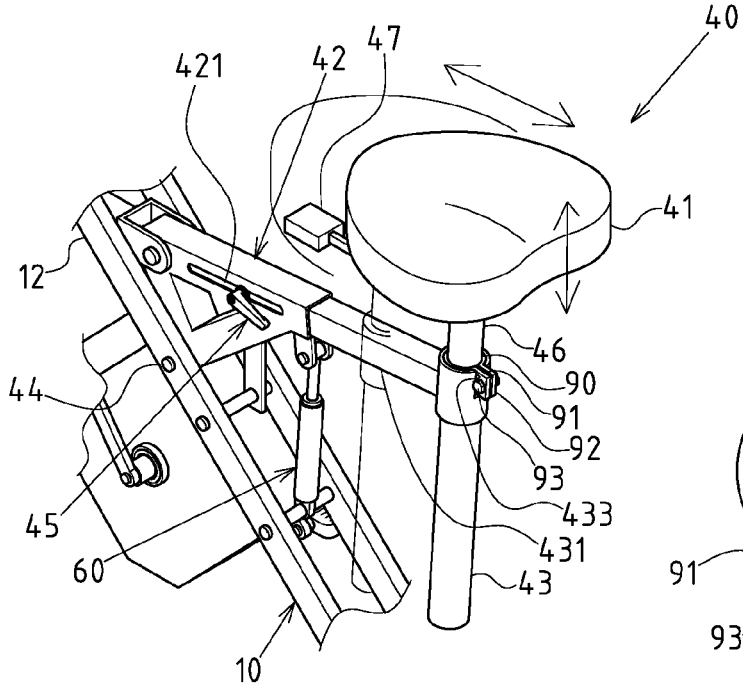
FIG. 10 shows a perspective view of the seat set of the present invention in an adjustable state.
Figure 12:
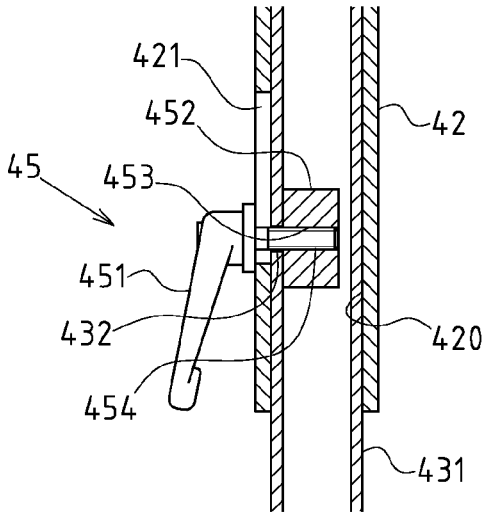
FIG. 12 shows a transverse sectional view of the linkage tube of the present invention in a positioning state.
Figure 13:
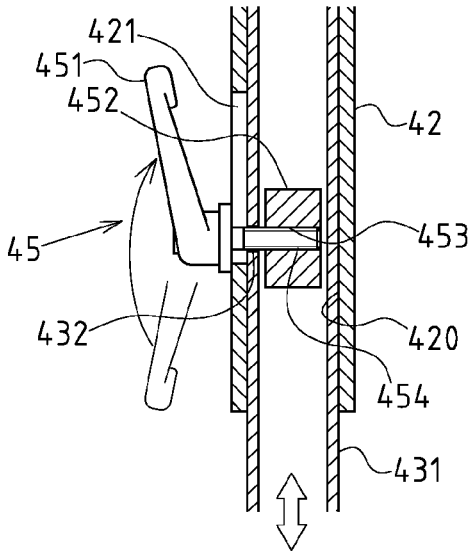
FIG. 13 shows a transverse sectional view of the linkage tube of the present invention in an adjustable state.

Referring to FIGS. 10, 12, a sliding chute 420 is mounted at rear end of rotatable rack 42 of the seat set 40, such that a transverse linkage tube 431 is extended from the front of upright rod 43 of cushion 41. With this linkage tube 431 retractable in the sliding chute 420, the cushion 41 could be adjusted flexibly. And, the sliding state of linkage tube 431 in the sliding chute 420 could be fixed by a locator 45. The locator 45 comprises a rotating handle 451 and a pressing block 452. The pressing block 452 is placed into a hollow space within linkage tube 431, and fitted with a bolt hole 453. A screw rod 454 extended from rotating handle 452 passes through a long hole 421 at one side of sliding chute 420 and a punch hole 432 at one side of linkage tube 431. Then, this screw rod 454 is screwed into bolt hole 453 of the said pressing block 452, such that the rotation of pressing block 452 can be deactivated. When the rotating handle 451 drives the screw rod 454 and bolt hole 453 to rotate tightly (as shown in FIG. 12), the pressing block 452 and rotating handle 451 will approach closely to position the linkage tube 431 and sliding chute 420. Referring also to FIG. 13, when the rotating handle 451 is loosened, pressing block 452 will move away from rotating handle 451, such that the linkage tube 431 can be flexibly adjusted in the sliding chute 420.

Figure 11:
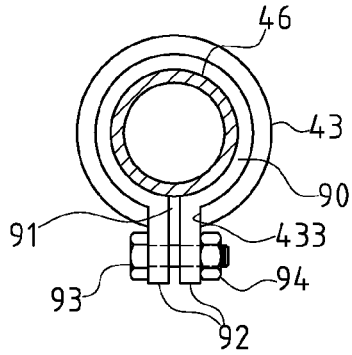
FIG. 11 shows a transverse sectional view of a locator structure of the cushion's nose bar of the present invention.

Referring to FIGS. 10, 11, a C-shaped jacket 90 is placed at top of upright rod 43 of the rotatable rack 42. At the lateral gap 91 of C-shaped jacket 90, there is a convex lug 92, which could adjust the tightness of C-shaped jacket 90 through bolt 93 and screw cap 94, such that a relieving slot 433 on top of upright rod 43 allows passing of convex lug 92 of C-shaped jacket 90, and the bottom of cushion 41 could insert into C-shaped jacket 90 via a nose bar 46. Thus, it helps to switch the lifting or positioning state of cushion 41 (inclusive of avoiding rotation and lifting of cushion 41) by adjusting the tightness of C-shaped jacket 90. If C-shaped jacket 90 is adjusted loosely, nose bar 46 will be loosened, such that the cushion 41 could elevate flexibly according to the height of the user. Also, a clamping handle 47 is mounted onto nose bar 46 at the bottom of cushion 41, thereby controlling pneumatically the lifting of cushion 41 (note: the inner space of upright rod 43 can accommodate the gas cylinder).

Figure 14:
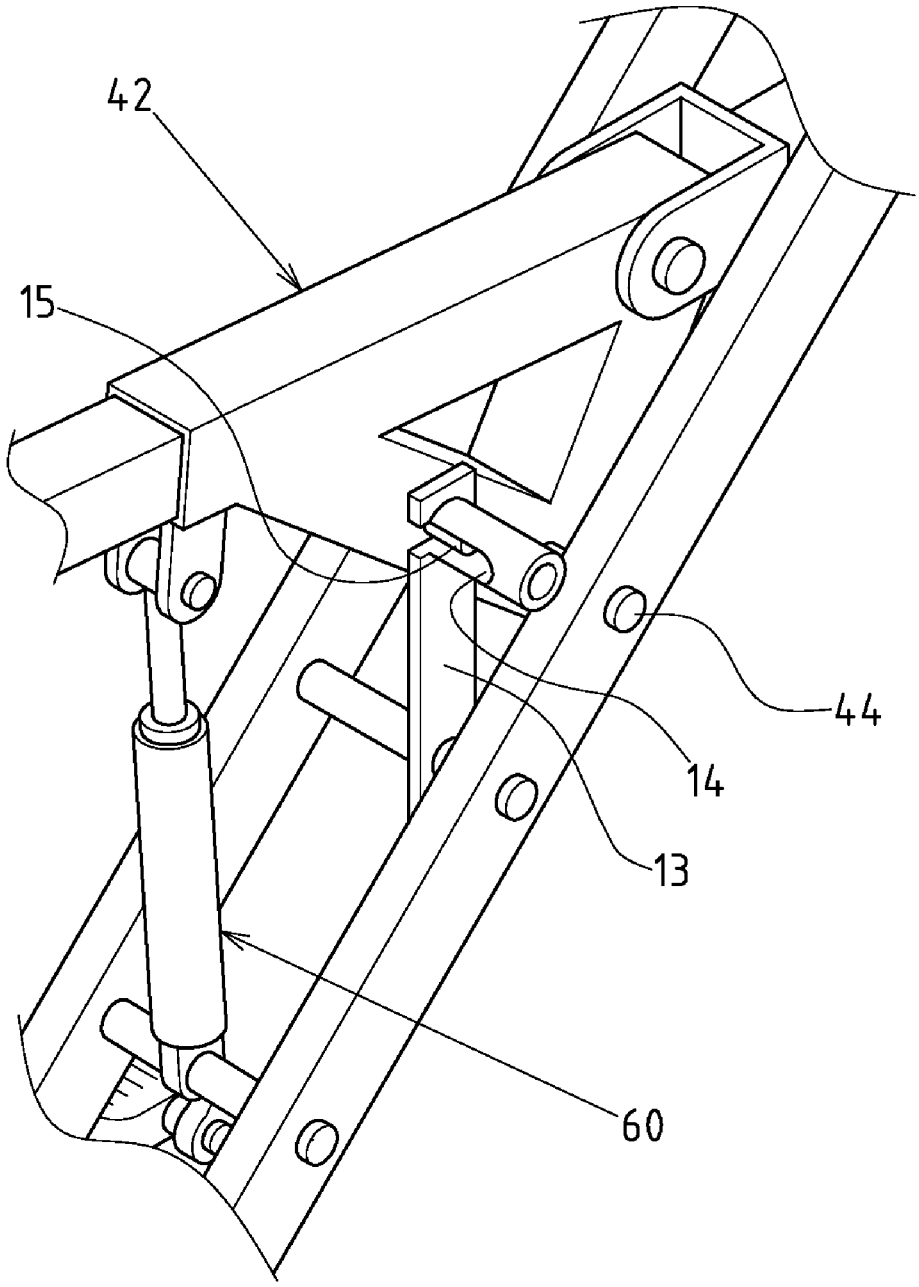
FIG. 14 shows a perspective view of rotatable rack of the present invention supported and positioned by the support frame.

Referring to FIG. 14, a support frame 13 is mounted between rotatable rack 42 of seat set 40 and upper-frame 12 of main frame 10. The bottom of the support frame 13 is screwed into upper-frame 12 of main frame 10, enabling rotation of the top of support frame 13. There is an embedding slot 14 at the top of support frame 13, such that an upright column 15 can be installed into upper-frame 12 of main frame 10, thereby positioning both the embedding slot 14 of support frame 13 and the rotatable rack 42.

Based upon the above-specified structural design, the fitness equipment of the present invention can serve the purpose of both horse-riding and trampling.

Figure 15:
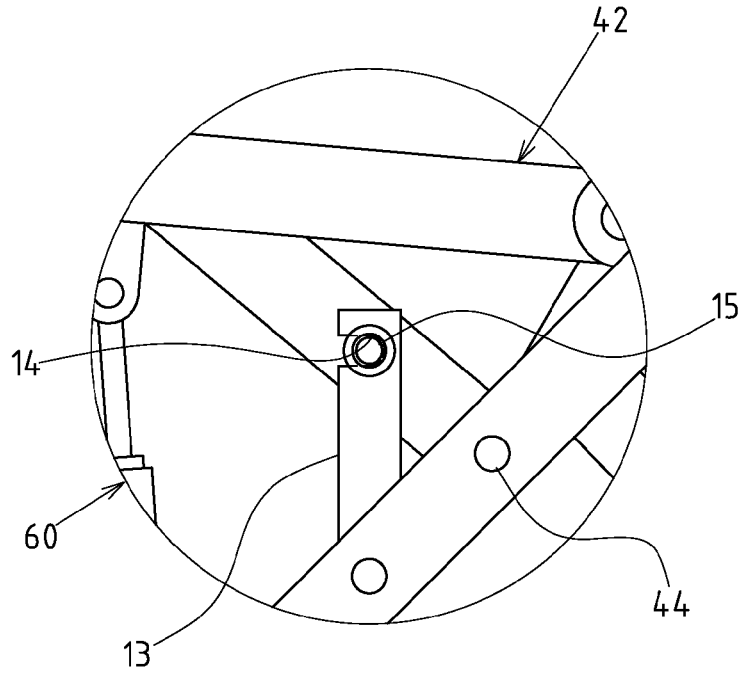
FIG. 15 shows an isolated elevation view of rotatable rack of the present invention supported and positioned by the support frame.
Figure 16:
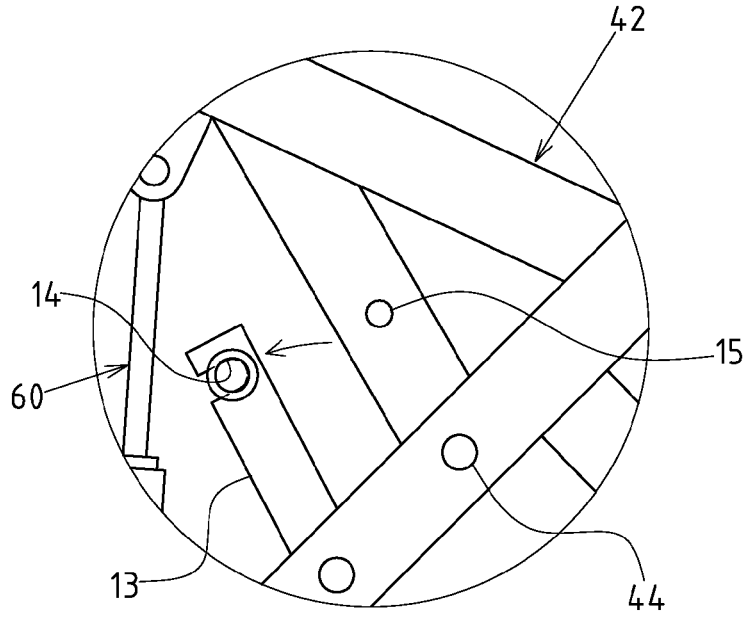
FIG. 16 is a similar elevation view to FIG. 15, with the support frame shown in a release state.
Figure 18:
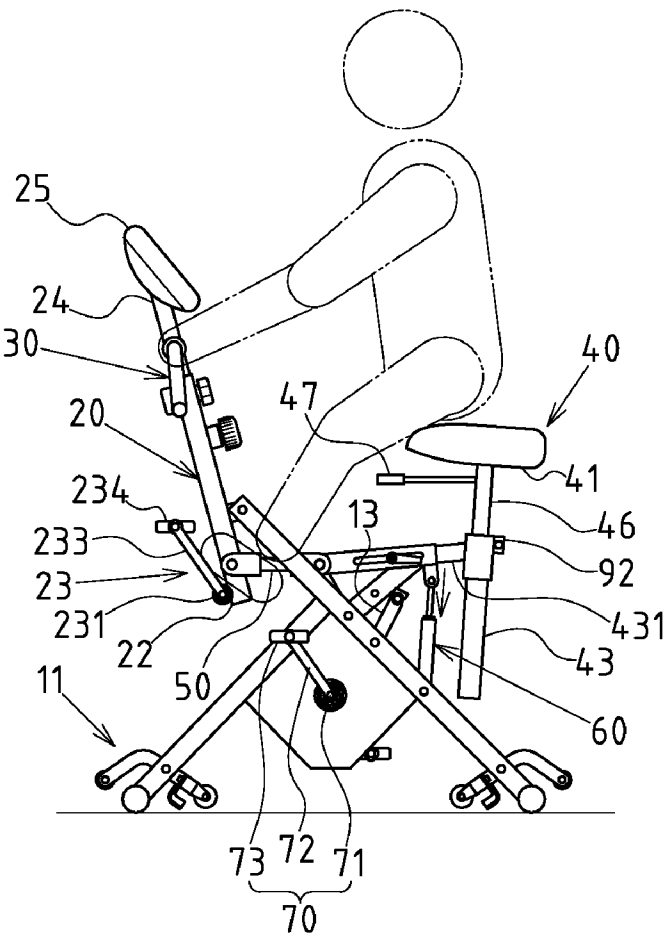
FIG. 18 shows an elevation view of the present invention in another state of operation.

Referring to FIGS. 15, 16, if the user intends to perform the horse-riding exercise, the support frame 13 is rotated to enable the embedding slot 14 to be separated from upright column 15 of upper-frame 12 of the main frame 10, thus making the rotatable rack 42 in a rotary state. Referring also to FIG. 17, the horse-riding exercise allows the user to grip the handrail rack 30 to pull the rotatable head rack 20 towards themselves, such that the bottom of rotatable head rack 20 will rotate forward to pull the linkage bar 50 and make rotatable rack 42 move obliquely. At the same time, the feet on the foot rest 23 apply downward force to lift the buttocks. In such a case, the damping device may support the cushion 41 of rotatable rack 42 to lift the buttocks of the user in a comfortable manner. Referring also to FIG. 18, the user will loosen the hands holding the handrail rack 30, and then make buttocks press down the cushion 41, such that the damping device 60 (retractable pneumatic shaft) is squeezed to generate resistance and accumulate elastic restoring force, as shown in FIGS. 17, 18.

Figure 19:
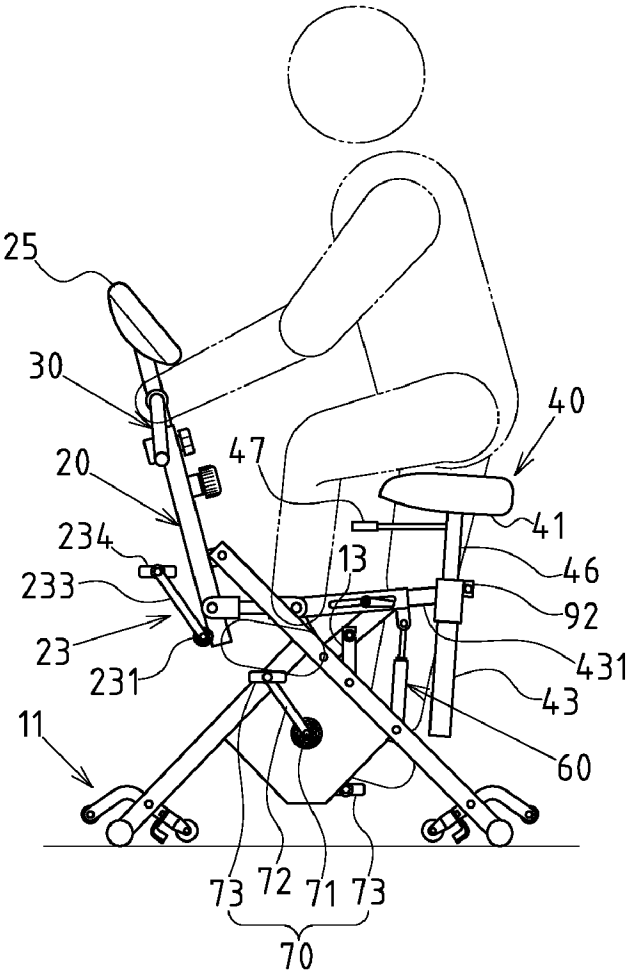
FIG. 19 shows an elevation view of the present invention in another state of operation.

When the user intends to perform a pedaling exercise on the fitness equipment, they must enable the embedding slot 14 of support frame 13 to be screwed into upright column 15 of upper-frame 12 of main frame 10 (referring to FIGS. 14, 15), thus enabling the rotatable rack 42 to be positioned. Referring also to FIG. 19, the user can step separately on two treadles 73 at both sides of rotatable treadle device 70 for a rotary body-building exercise.

I claim:

1. A multi-functional fitness apparatus comprising:

a main frame having a frontal and a rear underframe and an upper-frame;

a rotatable head rack having a lower section screwed into a top of said upper frame by a shaft extending downwardly from a bottom of said head rack;

a foot rest positioned at said bottom of said head rack;

a handrail rack mounted onto a top of said head rack;

a seat set having a cushion and a rotatable rack, said seat set having an upright rod positioned at a rear of said rotatable rack, said cushion affixed to said upright rod, said rotatable rack having a bottom screwed into a bottom of said upper frame by another shaft;

a linkage bar linked to said bottom of said rotatable head rack to a front end of said rotatable rack of said seat set;

a damping device mounted between said rotatable rack of said seat set and said main frame such that a resisting force is applied to a downward rotation of said rotatable rack;

a rotatable treadle device mounted into said main frame, said treadle device having a mandrel, a side crank, a treadle and a damper, said underframe comprising a cross-bar and a rotatable wheel rack arranged alternatively on said main frame, said wheel rack having a spanner fixed at a top thereof, said wheel rack having a wheel body at the bottom thereof, said bottom of said wheel rack being rotatable upwardly such that said underframe is grounded tightly by said cross-bar, said wheel rack being rotatable downwardly such that said wheel body is lowered downwardly to a bottom of said crossbar so as to cause said wheel body to be slidable, said bottom of said wheel rack being fastened by a locator.

2. The apparatus of claim 1, said foot rest comprising:

a horizontal support;

a linkage seat;

a rotary extension rod; and a foot plate, said horizontal support and said linkage seat being fastened tightly by a screw-and-bolt assembly, said rotary extension rod having a coupling end positioned externally at said linkage seat, said foot plate positioned at an extension end of said rotary extension rod.

3. The apparatus of claim 2, said horizontal support and said linkage seat having a sleeve and a spring retained externally thereof, said spring urging said sleeve toward said horizontal support and said linkage seat to cover said linkage seat.

4. The assembly of claim 1, said handrail rack having a curved section at opposite sides thereof, said head rack having a transverse hole at a top thereof for assembly of said handrail rack, said transverse hole having a pair of locators adhered respectively at opposite sides thereof.

5. The assembly of claim 4, the curved section being covered by a flexible coating.

6. The apparatus of claim 1, said locator being a hook-shaped plate screwed into a wheel rack, said hook-shaped plate enabling said plate to be snapped onto a top of said crossbar which said wheel rack rotates downwardly.

7. A multi-functional fitness equipment comprising:

a main frame having a frontal and a rear underframe and an upper-frame;

a rotatable head rack having a lower section screwed into a top of said upper-frame by a shaft extending downwardly from a bottom of said head rack;

a foot rest positioned at said bottom of said head rack;

a handrail rack mounted onto a top of said head rack;

a seat set having a cushion and a rotatable rack, said seat set having an upright rod positioned at a rear of said rotatable rack, said cushion affixed to said upright rod, said rotatable rack having a bottom screwed into a bottom of said upper frame by another shaft;

a linkage bar linked to said bottom of said rotatable head rack to a front end of said rotatable rack of said seat set;

a damping device mounted between said rotatable rack of said seat set and said main frame such that a resisting force is applied to a downward rotation of said rotatable rack;

a rotatable treadle device mounted into said main frame, said treadle device having a mandrel, a side crank, said rotatable rack having a sliding chute mounted at a rear end thereof, said upright rod of said cushion having a linkage tube extending from a front thereof, said linkage tube retractable in said sliding chute, said cushion being flexibly adjustable, a position of said linkage tube in said sliding chute being fixed by a locator.

8. The assembly of claim 7, said locator comprising a rotating handle and a pressing block, said pressing block positioned in an hollow space within said linkage tube, said pressing block being fitted with a bolt hole, said rotating handle having a screw rod extending so as to pass through an elongated hole at one side of said sliding chute and through a punch hole at one side of said linkage tube, said screw rod being screwed into said bolt hole.

9. The assembly of claim 7, said damping device being a retractable pneumatic shaft supporting said rotatable rack.

10. A multi-functional fitness equipment comprising:

a main frame having a frontal and a rear underframe and an upper-frame;

a rotatable head rack having a lower section screwed into a top of said upper-frame by a shaft extending downwardly from a bottom of said head rack;

a foot rest positioned at said bottom of said head rack;

a handrail rack mounted onto a top of said head rack;

a seat set having a cushion and a rotatable rack, said seat set having an upright rod positioned at a rear of said rotatable rack, said cushion affixed to said upright rod, said rotatable rack having a bottom screwed into a bottom of said upper frame by another shaft;

a linkage bar linked to said bottom of said rotatable head rack to a front end of said rotatable rack of said seat set;

a damping device mounted between said rotatable rack of said seat set and said main frame such that a resisting force is applied to a downward rotation of said rotatable rack;

a rotatable treadle device mounted into said main frame, said treadle device having a mandrel, a side crank, said rotatable rack and said upper frame having a support frame mounted therebetween, said support frame having a bottom screwed into said upper frame so as to allow a rotation of a top of said support frame, said top of said support frame having an embedding slot receiving an upright column so as to position both said embedding slot and said rotatable rack.

11. The assembly of claim 10, said upright rod of said rotatable rack having a C-shaped jacket at a top thereof, a convex lug being positioned in a lateral gap so as to adjust a tightness of said C-shaped jacket by a bolt-and-screw cap, said upright rod having a relieving slot at a top thereof so as to allow a passing of said convex lug therethrough, said cushion having a bottom inserted into said C-shaped jacket by a nose bar.

12. The assembly of claim 11, said nose bar having a clamping handle mounted thereto so as to control a lifting of said cushion.

* * * * *